US007637629B1

(12) United States Patent
Roberts et al.

(10) Patent No.: US 7,637,629 B1
(45) Date of Patent: Dec. 29, 2009

(54) THREADED-STUD XENON SHORT-ARC LAMP SYSTEM

(75) Inventors: Roy D. Roberts, Hayward, CA (US); Daniel J. O'Hare, Livermore, CA (US); James P. Huynh, Fremont, CA (US); Say Phonpradith, Manteca, CA (US)

(73) Assignee: Vaconcis Lighting, Inc., Fremont, CA (US)

( * ) Notice: Subject to any disclaimer, the term of this patent is extended or adjusted under 35 U.S.C. 154(b) by 520 days.

(21) Appl. No.: 11/400,706

(22) Filed: Apr. 6, 2006

(51) Int. Cl.
*F21V 29/00* (2006.01)

(52) U.S. Cl. ..... 362/264; 362/294

(58) Field of Classification Search ..... 362/263, 362/264, 294, 373; 313/42, 45, 46
See application file for complete search history.

(56) References Cited

U.S. PATENT DOCUMENTS 4,219,871 A * 8/1980 Larrimore ..... 362/264
4,841,422 A * 6/1989 Groh ..... 362/294
6,896,392 B2 * 5/2005 Jigamian et al. ..... 362/202
6,974,233 B1 * 12/2005 Aubrey ..... 362/294

* cited by examiner

*Primary Examiner*—Thomas M Sember
(74) *Attorney, Agent, or Firm*—Law Offices of Thomas E. Schatzel, P.C.

(57) ABSTRACT

A xenon short-arc lamp system includes a choice of two anode heatsinks with different mechanisms for thermally interfacing to, and supporting, e.g., a 300W-400W xenon short-arc lamp. One heatsink, allows a conventional mounting in which a split ring and clamp combination accommodate and clamp to a screw-on base adapter fitted to the 300W-400W xenon short-arc lamp. The lamp can then be operated at 300W. The second heatsink accommodates the 300W-400W xenon short-arc lamp directly without the adapter. A large threaded stud on the lamp is screwed directly into the heatsink and is seated such that a large orthogonal flat planar annular ring area also makes a tight thermal connection. The lamp can then be operated at its higher limit because of the much improved thermal resistance.

8 Claims, 2 Drawing Sheets

Figure 1:
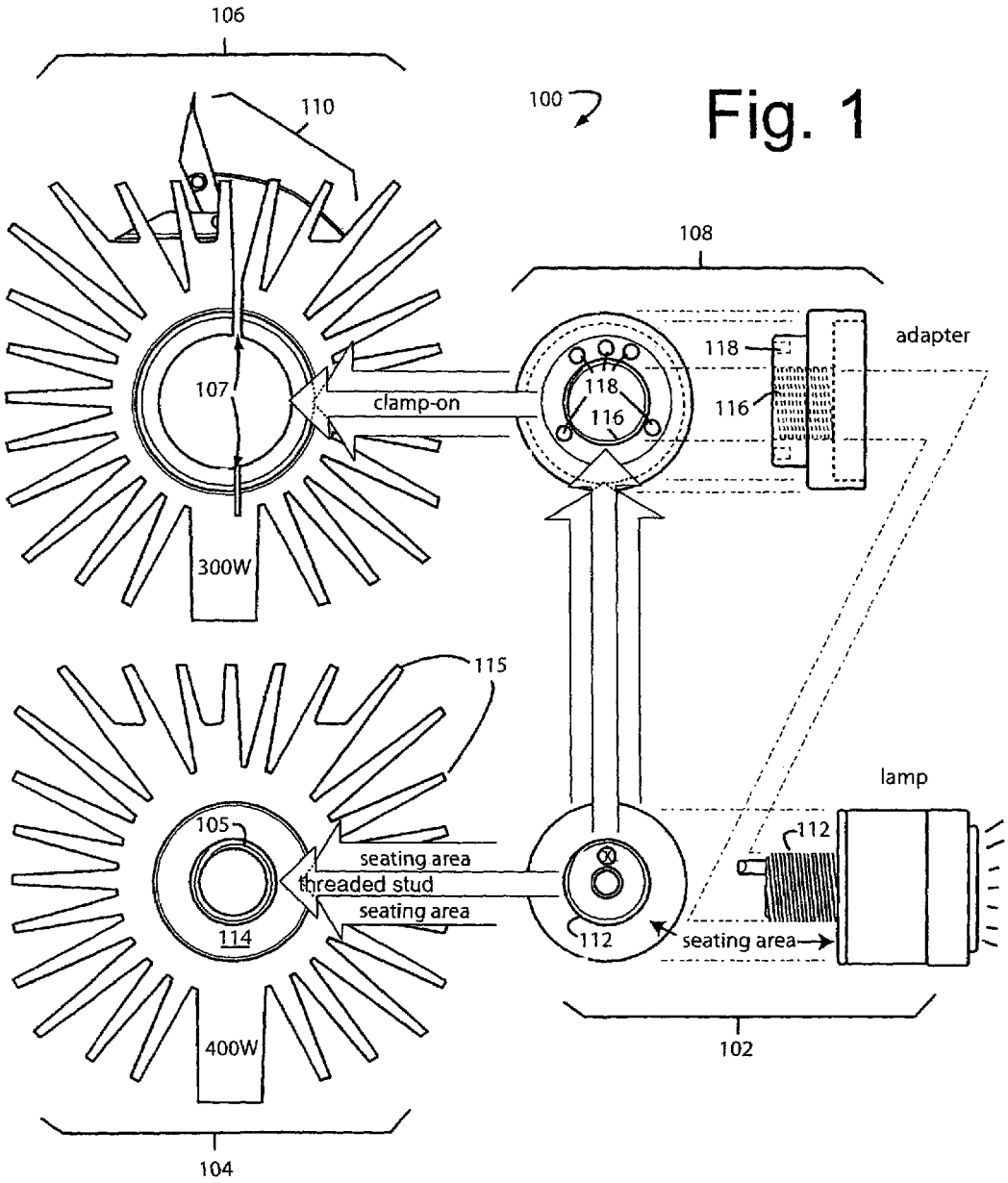

106
110
100

108
adapter
118
116
107
clamp-on
118
116
300W
115
lamp
105
seating area
threaded stud
seating area
114
112
112
seating area
400W
102
104

THREADED-STUD XENON SHORT-ARC LAMP SYSTEM

BACKGROUND OF THE INVENTION

1. Field of the Invention

The present invention relates to xenon arc lamps, and in particular to 400W arc lamps with threaded heatsink studs that can alternatively be retrofitted to conventional clamp-on heatsinks with the use of an adapter.

2. Description of the Prior Art

The arc lamp industry is like other markets in that there is a constant demand for higher levels of performance while at the same time the market insists that new products must fit into the existing sockets and not require a whole new investment. Conventional 300W xenon short-arc lamps, e.g., Perkin-Elmer CERMAX xenon lamps, generate a lot of heat that must be removed efficiently. A typical 300W arc lamp is clamped at its anode base by a 3.0"×3.25"×1.25" finned aluminum heatsink with a forced air flow.

SUMMARY OF THE INVENTION

Briefly, a xenon short-arc lamp system embodiment of the present invention includes a choice of two anode heatsinks with different mechanisms for thermally interfacing to, and supporting xenon short-arc lamps. For example, one heatsink allows a conventional mounting in which a split ring and clamp combination accommodate and clamp to a screw-on base adapter fitted to the 300W-400W xenon short-arc lamp. The lamp can then be operated at 300W. The second heatsink accommodates the 300W-400W xenon short-arc lamp directly without the adapter. A large threaded stud on the lamp is screwed directly into the heatsink and is seated such that a large orthogonal flat planar annular ring area also makes a tight thermal connection. The lamp can then be operated at its higher 400W limit because of the much improved thermal resistance.

An advantage of the present invention is that a lamp system is provided that can operate at 33% higher powers, compared to similar conventional systems.

A further advantage of the present invention is that a lamp and heatsink combination is provided that can be operated with less or no forced air circulation.

Another advantage of the present invention is that a lamp system is provided with a longer operating life and quieter operation.

A still further advantage of the present invention is that a lamp system is provided in which each replacement lamp's alignment with the optical system is repeatable between lamp replacements.

These and other objects and advantages of the present invention will no doubt become obvious to those of ordinary skill in the art after having read the following detailed description of the preferred embodiments which are illustrated in the various drawing figures.

IN THE DRAWINGS

Figure 2:
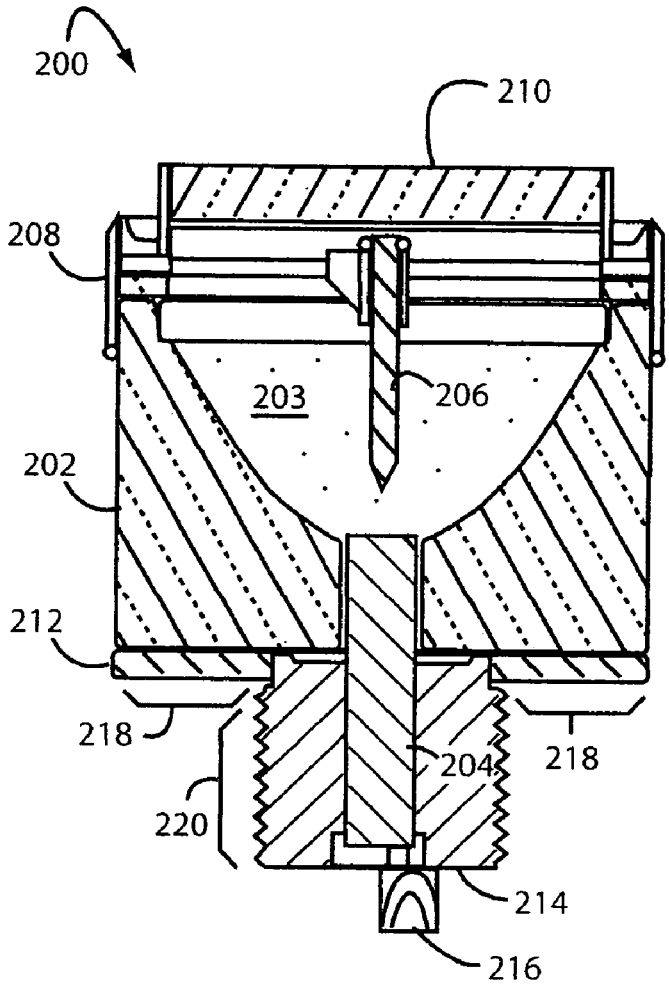

FIG. 1 is a xenon short-arc lamp system embodiment of the present invention showing a choice of two heatsinks. One of which can accommodate the lamp directly by screwing them together. The other heatsink can be a conventional one that can accommodate and be retrofitted with the improved lamp by using the special screw-on adapter illustrated; and FIG. 2 is a longitudinal cross-sectional diagram a lamp embodiment of the present invention useful as shown in FIG. 1.

DETAILED DESCRIPTION OF THE PREFERRED EMBODIMENT

FIG. 1 represents a modular arc-lamp and heatsink system embodiment of the present invention, and is referred to herein by the general reference numeral 100. The modular arc-lamp and anode heatsink system 100 comprises a xenon short-arc lamp 102 that can be screwed into a 400W heatsink 104 with a threaded hole 105. Or, it may be clamped into a 300W heatsink 106 having a split 107. Such lamp is held in with the aid of an adapter 108. Conventional cathode heatsinks may also be included in practical implementations. A clamp 110 in the 300W heatsink 106 allows easy insertion of the adapter 108 or a conventional short-arc lamp, and provides for a tight thermal connection when clamped-down.

The 300W heatsink 106, alone, resembles a conventional unit, and similar ones may already be pre-existing in customers' equipment. The adapter 108 allows the new type of xenon short-arc lamp 102 to be installed without necessitating the installation and use of the new type of 400W heatsink 104. The outside form factor of 400W heatsink 104 is very similar to the 300W heatsink 106, but the xenon short-arc lamp 102 can be operated 100W higher because the quality of the thermal connections through a threaded copper stud 112 and a recessed seating area 114 are so good. The basic material of the heatsink 104 is a good heat-conducting metal like copper or a finned aluminum extrusion 115 with Alodyne plating. Alodyne is a chromic acid conversion process that leaves a corrosion resistant film on aluminum surfaces.

In typical applications, the combination of xenon short-arc lamp 102 and 400W heatsink. 104 may not require a forced air flow, or as much forced air flow, compared to applications using conventional arc-lamps and heatsinks similar to the 300W heatsink 106.

The adapter 108 also includes a threaded hole 116 compatible with threaded stud 112. A number of mounting screw holes 118 are provided that match those in conventional lamps accommodated by conventional heatsinks like heatsink 106.

In one embodiment of the present invention, the xenon short-arc lamp 102 is a Vaconics (Fremont, Calif.) VAC175-F-C-MB with a one-inch lens diameter, 1.25" outside diameter ceramic body, a 2.0" overall length, and a 0.5625" diameter copper threaded stud. The 400W heatsink 104 and 300W heatsink 106 are each 3.0"×3.25"×1.25" finned extruded aluminum with a forced air flow.

FIG. 2 is a xenon short-arc lamp embodiment of the present invention, and is referred to herein by the general reference number 200. Lamp 200 is similar to lamp 102 in FIG. 1. Lamp 200 comprises a ceramic body 202, a xenon gas fill 203, a tungsten anode 204, a tungsten cathode 206, a Kovar cathode sleeve 208 brazed to the body, a sapphire lens 210, a flat annular ring 212 brazed to the body, a copper anode mounting stud 214 brazed to the anode, and a pinched-off gas-fill tubulation 216. In general, nickel plating and copper-silver brazing are used throughout. A flat orthogonal ring-annular seating area 218 and threading 220 allow for the lamp 200 to make a relatively large and thermally efficient contact with 400W heatsink 104 or adapter 108. The relative sizes of these are selected for maximum heat transfer performance depending on lamp power which is not limited to 300W-400W.

In a one inch lens size, lamp 200 can be operated in the range of 100W-400W, depending on heatsink efficiency. It can be operated at 400W with heatsink 104 because of the choices of materials and the way the heatsink seats on area 218 and engages threads 220. In one experiment that produced good results, the threaded base 214 was 0.44" long, and 0.56" in diameter with standard coarse machine threads 220. The flat annular ring 212 was 0.06" thick, 1.24" in outside diameter, made of Kovar, and brazed to both the body 202 and stud 214. The overall length of lamp 200 was 1.64", not including the pinched-off gas-fill tubulation 216. Other similar sizes, of course, are also possible in commercial applications.

In general, a xenon short-arc lamp system embodiments of the present invention include a choice of first and second short-arc lamp anode heatsinks 106, 104, made of extruded finned aluminum, in which the first includes a split 107 and a clamp 110 for a user to close a gap in the split for securing it to a first lamp for cooling, and the second includes a single, coaxial, female threaded machine screw hole 105 to accept and secure it to a second lamp 102 with a matching base stud 112 for cooling, wherein the tighter and more intimate connection of the second lamp 102 and its base stud 112 to the second heatsink 104 has a significantly better heat transfer characteristic than that of the first lamp to the first heatsink 106. A base adapter 108 provides for the second lamp 102 to be accommodated by the first heatsink 106 by accepting its base stud in a screw hole 114, and presenting a cylindrical lamp base to the first heatsink for clamping. The first lamp is a conventional xenon short-arc lamp with standardized cylindrical dimensions. And, the second lamp 102 and base adapter 108 when screwed together approximate the cylindrical dimensions of the first lamp and can functionally replace it, and the second lamp 102 and base stud 112 can be screwed directly into the second heatsink 104 and operated at relatively higher power than with the base adapter 108. The second lamp 102 usually comprises a xenon short-arc lamp with a ceramic body 202, a tungsten anode 204 and cathode 206, a threaded copper base stud 214 a Kovar anode ring 212 and cathode 208 electrode sleeve, and a nickel plating externally covering the base stud and Kovar anode ring and cathode sleeves.

The seating area 218 on the flat ring 212 is annular to a non-distal end of the base stud 214, and provides for heat transfer in balance with the base stud to either directly the second heatsink 104, or indirectly through the base adapter 108 to the first heatsink 106. Such seating area 218 may be approximately 1.24" in outside diameter, and about 0.56" in inside diameter, it is orthogonal and coaxial to the base stud. The base stud 214 is about 0.56" in diameter with a 9/16-24 machine thread 220. The short-arc lamp 200, has a threaded base stud 214 made of copper and provides for heat transfer to a heatsink 104 and mechanical support of an anode end of the lamp 200. The annular seating area 218 is concentric with one end of the threaded base stud 214 and provides for a heat transfer contact with the heatsink 104 when the threaded base stud is fully screwed into the heatsink. A ceramic body 202, xenon gas fill 203, and cathode 206 and anode 204 assembly, all are connected to the annular seating area 218 and are supported by the threaded base stud 214. Together these provide for disposal of lamp heat generated during operation. The relative heatsink contact surface areas and masses of the threaded base stud 214 and annular seating area 218 are selected such that a maximum of heat transfer can occur during operation.

The foregoing design described can be readily scaled to much higher power levels in excess of 2.5 kilowatts.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

The invention claimed is:

1. A xenon short-arc lamp system, comprising:

a first and a second short-arc lamp anode heatsink (106, 104) having substantially different heat capacities from one another, and both having similar outside form factors and made of extruded finned aluminum, wherein, the first heatsink (106) includes a split (107) and a clamp (110) to close a gap in the split for securing it to a lamp (102) screwed with a matching base stud (112) into a base adapter (108) for cooling, and the second heatsink (104) includes a single, coaxial, female threaded machine screw hole (105) to directly accept and secure it to lamp (102) with matching base stud (112) for cooling, wherein the tighter and more intimate connection of said lamp (102) and its base stud (112) to the second heatsink (104) has a significantly better heat transfer characteristic than that of the first heatsink (106); and a base adapter (108) providing for said lamp (102) to be accommodated by the first heatsink (106) by accepting its base stud (112) directly in a screw hole (114), and for presenting a cylindrical lamp base format of a conventional xenon short-arc lamp with standardized cylindrical dimensions to the first heatsink (106) for clamping;

wherein, said lamp (102) and base adapter (108) when screwed together approximate said cylindrical lamp base format of said conventional xenon short-arc lamp and can functionally replace it, and said lamp (102) and base stud (112) can be screwed directly into the second heatsink (104) and operated at a substantially higher power than heatsink (106).

2. The system of claim 1, further comprising as said lamp (102):

a xenon short-arc lamp with a ceramic body (202), a tungsten anode (204) and cathode (206), a threaded copper base stud (214) a Kovar ring (212) and sleeve (208), and a nickel plating externally covering said base stud and Kovar equivalent ring and sleeve.

3. The system of claim 2, further comprising:

a seating area (218) on said ring (212) that is annular to a non-distal end of said base stud (214), and that provides for maximized heat transfer by being mutually proportioned with said base stud and for mounting directly the second heatsink (104), or indirectly through the base adapter (108) to the first heatsink (106).

4. The system of claim 2, wherein:

the seating area (218) is approximately 1.24" in outside diameter, and is about 0.56" in inside diameter, and is orthogonal and coaxial to the base stud; and the base stud (214) is about 0.56" in diameter with a 9/16-24 machine thread (220);

wherein said dimensions may be proportionately scaled and still maintain these interrelationships.

5. A short-arc lamp (200), comprising:

a threaded base stud (214) made of copper equivalent and providing for heat transfer to a heatsink (104) and mechanical support of an anode end of the lamp (200);

an annular seating area (218) concentric with one end of the threaded base stud (214) and providing for a heat transfer contact with said heatsink (104) when the threaded base stud is fully screwed into said heatsink; and a ceramic body (202), xenon gas fill (203), and cathode (206) and anode (204) assembly, all connected to the annular seating area (218) and supported by the threaded base stud (214) which together provide for disposal of lamp heat generated during operation;

wherein, the relative heatsink contact surface areas and masses of the threaded base stud (214) and annular seating area (218) are selected such that a maximum of heat transfer can occur during operation.

6. The lamp of claim 5, wherein:

the seating area (218) is approximately 1.24" in outside diameter, and is about 0.56" in inside diameter, and is orthogonal and coaxial to the base stud; and the base stud (214) is about 0.56" in diameter with a 9/16-24 machine thread (220);

wherein said dimensions may be proportionately scaled and still maintain these interrelationships.

7. The lamp of claim 6, wherein:

wherein the ceramic body (202), xenon gas fill (203), cathode (206) and anode (204) assembly, annular seating area (218) and threaded base stud (214) are proportionately scaled to maintain such dimensional interrelationships for high power operation in excess of 2500 watts.

8. A short-arc lamp heatsink (104), comprising:

a solid one-piece radial finned aluminum extrusion (115) for receiving a forced air flow, and provided with an outside form factor equivalent in size and configuration to another heatsink (106) having a substantially lesser heat capacity;

disposed in the material of the radial finned aluminum extrusion (115), a flat, round, recessed seating area (114) in a center of and parallel to one end of the finned aluminum extrusion, and configured for receiving heat transfer from a seating area (218) of a xenon short-arc lamp (200) with a threaded base stud (214); and disposed in the material of the radial finned aluminum extrusion (115) and through a center of the recessed seating area (114), a threaded hole (105) providing for a screw-in assembly and mounting of said threaded base stud (214), and configured for receiving heat transfer though said threaded base stud (214);

wherein, the relative sizes and contact areas between the recessed seating area (114) and the lamp seating area (218), and the threaded hole (105) and threaded-stud (214), are mutually proportioned to provide a maximum of overall heat transfer from the lamp (200) to the heatsink (104).

* * * * *